US006302975B1

(12) United States Patent
Kung

(10) Patent No.: US 6,302,975 B1
(45) Date of Patent: Oct. 16, 2001

(54) METHOD FOR INCREASING FRACTURE TOUGHNESS IN ALUMINUM-BASED DIFFUSION COATINGS

(75) Inventor: Steven C. Kung, North Canton, OH (US)

(73) Assignee: McDermott Technology, Inc., New Orleans, LA (US)

( * ) Notice: Subject to any disclaimer, the term of this patent is extended or adjusted under 35 U.S.C. 154(b) by 0 days.

(21) Appl. No.: 09/415,980

(22) Filed: Oct. 12, 1999

(51) Int. Cl.[7] ..... C23C 4/10; C21D 1/09

(52) U.S. Cl. ..... 148/525; 148/531; 427/456; 427/376.8

(58) Field of Search ..... 427/456, 376.8; 148/525, 531

(56) References Cited

U.S. PATENT DOCUMENTS

| | | | | |
|---|---|---|---|---|
| 4,004,047 | | 1/1977 | Grisik . | |
| 4,500,364 | | 2/1985 | Krutenat . | |
| 4,655,852 | * | 4/1987 | Rallis | 148/6.11 |
| 4,904,501 | | 2/1990 | Davis . | |
| 5,041,309 | | 8/1991 | Davis et al. . | |
| 5,135,777 | | 8/1992 | Davis et al. . | |
| 5,208,071 | | 5/1993 | Davis et al. . | |
| 5,364,659 | | 11/1994 | Rapp et al. . | |
| 5,492,727 | | 2/1996 | Rapp et al. . | |
| 5,589,220 | | 12/1996 | Rapp et al. . | |
| 5,873,951 | | 2/1999 | Wynns et al. . | |
| 5,972,429 | | 10/1999 | Bayer et al. . | |
| 6,165,286 | * | 12/2000 | Bayer et al. | 148/220 |

* cited by examiner

*Primary Examiner*—George Wyszomierski
*Assistant Examiner*—Janelle Combs-Morillo
(74) *Attorney, Agent, or Firm*—R. C. Baraona; Eric Marich

(57) ABSTRACT

A method for improving the fracture toughness for aluminum-based diffusion coatings by thermal spray means to simultaneously apply aluminum, chromium, boron, and/or silicon onto a steel workpiece, followed by heat treatment of the workpiece for a sufficient time to cause the aluminum, chromium, boron, and/or silicon to diffuse into the workpiece. The resulting diffusion coating demonstrates improved fracture toughness and does not necessitate the use of a slurry.

14 Claims, 4 Drawing Sheets

METHOD FOR INCREASING FRACTURE TOUGHNESS IN ALUMINUM-BASED DIFFUSION COATINGS

FIELD AND BACKGROUND OF INVENTION

The present invention relates generally to diffusion coating methods and specifically to a new and improved method for aluminizing steel components, and especially boiler components, to improve resistance to high-temperature corrosion.

Aluminum diffusion coating has been widely used for decades to protect various components from high-temperature corrosion attack. By way of example and not limitation, the aerospace industry has been applying aluminum diffusion coating on the surfaces of turbine blades to prolong the service lives of gas engines. Accordingly, several prior art aluminizing processes for the production of aluminum diffusion coating on steels have been developed and used on large components, such as furnace wall panels for boilers, in order to improve the quality of the component and/or to improve the process control involved in producing the component.

One aluminizing method is described in U.S. Pat. No. 5,135,777 to Davis, et al., which is hereby incorporated by reference. Essentially, this method involves placing a slurry-coated ceramic alumino-silicate fiber next to a workpiece and heating the combination until the slurry coating diffuses onto the workpiece. Significantly, a halide activator must be included in the slurry coating in order to effect the diffusion of the slurry material.

Another aluminizing process known to those skilled in the art involves applying a layer of commercial-grade aluminum onto the surfaces of a workpiece by means of thermal spray (e.g., plasma or arc spray). In aluminum thermal spray, feed material in the form of powder or wire is rapidly melted and injected to the substrate. The molten aluminum particles spread out and splatter as they strike the surfaces to be coated. These particles first bond to the substrate and then to each other, forming a surface layer. The aluminum sprayed parts are then heat treated at elevated temperatures in a furnace under an inert or reducing atmosphere. Such heating causes the aluminum to diffuse from the sprayed layer into the substrate surfaces of the workpiece. Once this diffusion occurs, the aluminum becomes an integral part of the workpiece and any remnant of the aluminum spray layer can be easily removed, leaving only an aluminizing diffusion coating on the workpiece. Although no halide activator is utilized in this process, this process has been limited solely to the use of a single element (i.e., commercial-grade aluminum), rather than a combination of elements. Further, as demonstrated by U.S. Pat. No. 5,873,951 to Wynns, et al. (which is hereby incorporated in its entirety), those skilled in the art had believed that introduction of chromium into an aluminizing process will produce instability in the alloy structures. Further, as discussed in Wynns, et al., many prior art methods (including Wynns, et al.) contemplated multi-step processes for diffusing aluminum and, in some cases, chromium or silicon.

Moreover, when the workpiece consists of steel, use of a thermal spray aluminizing process produces a multi-layered coating structure on the steel surface. The outer layers of this multi-layer coating structure consist of Fe—Al ordered phases, also known as intermetallic compounds, such as FeAl and $Fe_3Al$. Although these aluminides are very corrosion resistant, they possess very low fracture toughness which makes them brittle and susceptible to mechanical damage. As a result, a workpiece aluminized by the thermal spray process must be handled with care to avoid accidental cracking and spallation of the coating.

In light of the foregoing, a diffusion coating material and method with improved fracture toughness is needed. Further, a thermal spray material for aluminizing which would allow multiple elements to be diffused simultaneously into steel surfaces would be welcome by the industry. Finally, a method for simultaneously introducing aluminum in conjunction with minor amounts boron and/or chromium into steel surfaces in order to increase fracture toughness without the use of a halide activator is desired.

SUMMARY OF THE INVENTION

Studies suggest that the main cause for low fracture toughness in polycrystalline FeAl and $Fe_3Al$ is moisture-induced hydrogen embrittlement resulting from atmospheric corrosion, which segregates hydrogen atoms to the crack tips and on the cleavage planes. In contrast, without this hydrogen embrittlement, tensile elongations greater than 17% have been observed for FeAl in dry air. Moreover, studies show that the addition of chromium up to 5 at. % (atomic percent, which is calculated the same way as a molar percentage) retards the penetration of hydrogen, thereby improving their fracture toughness. The ductility of iron aluminides can be further enhanced by introducing a trace amount of boron, such that the boron will segregate to grain boundaries and change the fracture mode of these materials from intergranular to transgranular. Despite the fact that the beneficial effects of chromium and boron used within bulk iron aluminides are known, those skilled in the art cannot and have not previously incorporated these elements into a diffusion coating system which incorporates a thermal spray.

The present invention comprises a method for improving the fracture toughness of aluminum-based diffusion coatings. This improved method involves preparing a feed material which is subsequently sprayed onto the workpiece. The feed material contains aluminum in conjunction with chromium and/or boron in a mixed or alloyed powder or another form of solid. If the feed material is another form of solid, it most advantageously has the form of a wire. The sprayed workpiece is then heat treated under an inert or reducing atmosphere for a sufficient amount of time to cause the feed material to diffuse into the workpiece surfaces. Finally, any excess feed material is removed from the workpiece.

A second embodiment of the invention comprises preparing a feed material containing aluminum in conjunction with chromium and/or boron in a mixed or alloyed powder or other solid form. Again, the other solid form of the feed material is most advantageously provided as a wire. The feed material is subsequently sprayed onto a ceramic media. Next, the media is placed in direct contact with the workpiece and the media and workpiece are heat treated for a sufficient amount of time to cause the metals on the ceramic media surface to diffuse into the workpiece. As above, the excess feed material, as well as the ceramic media, is then removed from the workpiece.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

The simultaneous diffusion coating of aluminum in conjunction with chromium and/or boron onto a steel workpiece, such as steel boiler components, will improve the corrosion resistance of the workpiece and overall fracture toughness of the resulting coating while reducing costs associated with the application of such coatings. While the invention has particular application to steel boiler components, it is equally applicable to any workpiece wherein improved corrosion resistance and/or improved fracture toughness of the aluminum based diffusion coating is desired. The simultaneous coating can be achieved in one of two methods.

In the first embodiment, the aluminum, chromium, and boron are applied using any known thermal spray means. Advantageously, this thermal spray means comprises any available commercial thermal spray process, such as wire arc spraying or plasma spraying. In such a process, a feed material made of the desired coating material is fed into a gun, which is heated by electricity and/or combustion. Preferably, the feed material is a powder or wire, although any solid suitable for use with the gun is contemplated. After being fed into the gun, the feed material melts.

Figure 1:
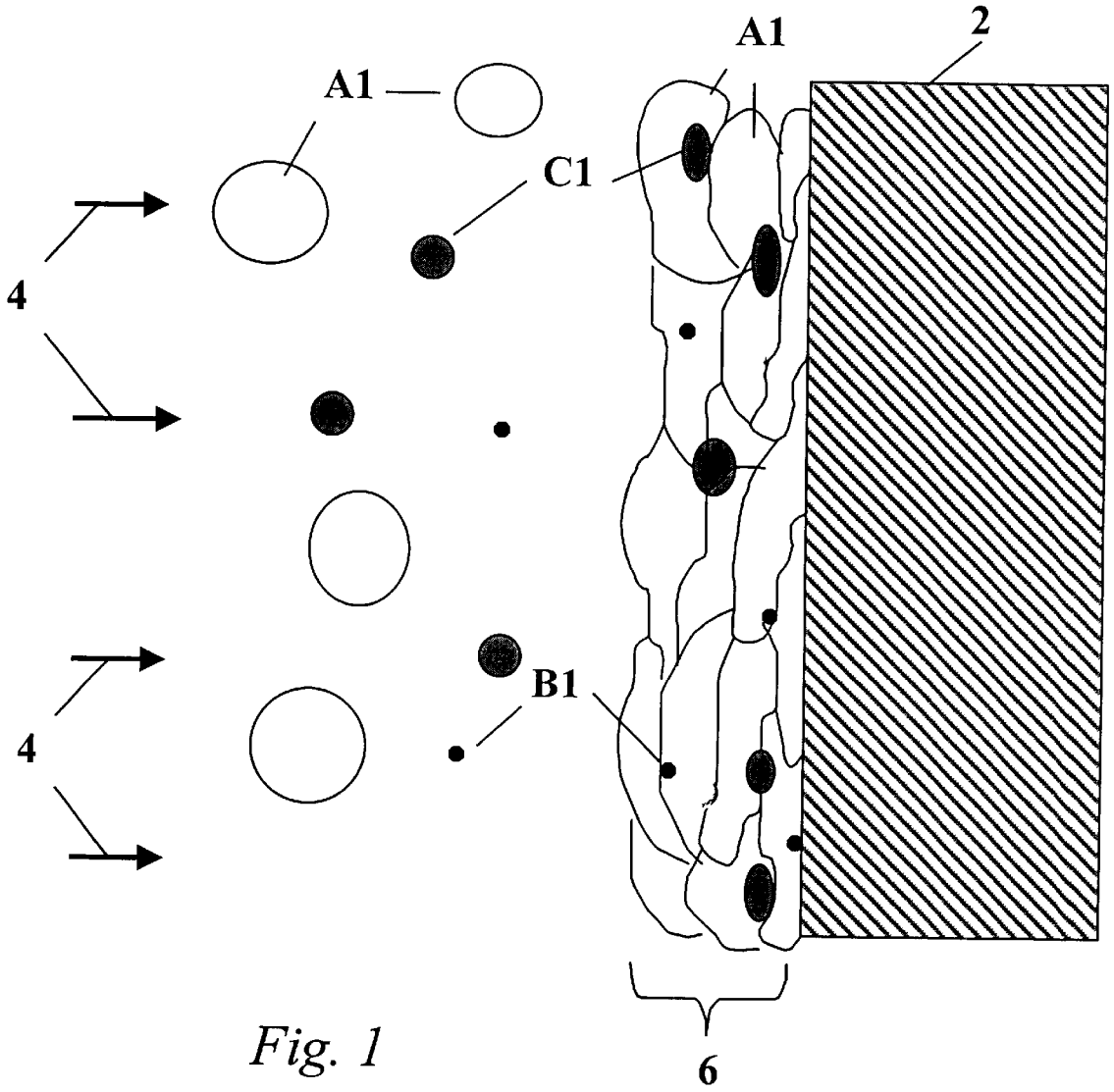
FIG. 1 is a schematic, cross-sectional representation of the thermal spray process as applied to the first embodiment of the present invention.

Referring to FIG. 1, the molten feed material, generally shown as A1, B1, and C1, is then propelled from the gun (not shown) toward workpiece 2 by gas means 4. The gas 4 may be argon, nitrogen, combustion gases (either derived from the heating of the gun or separately provided), compressed air, or any gas suitable for use with the particular thermal spray process. Small diameter particles (10–50 microns) of the molten feed material A1, B1, C1 are accelerated toward workpiece 2. A1 represents molten aluminum. B1 represents molten boron and C1 represents molten chromium, although it is understood that the invention encompasses the use of either boron or chromium singly (such that only B1 or only C1 is provided; not shown) or in combination (as shown).

The small diameter particles of molten feed material A1, B1, C1 then contact the workpiece, where they form coating layer 6. Coating layer 6 forms after molten feed material A1, B1, C1 cools and bonds to the surface of workpiece 2. Coating layer 6 typically consists of particles of varying sizes, shapes, and degrees of melting.

In order to achieve the simultaneous spraying (and subsequent diffusion) of the aluminum, chromium, and boron, these metals are provided in a feed material as discussed above. Notably, the feed material must have the constituent metals distributed uniformly. This uniformity may be achieved by mixing the powdered forms of these metals, by melting and mixing the metals into an alloyed solid, or by other uniform mixing means known to those skilled in the art. Alternatively, uniformity may be achieved by simultaneously thermally spraying the metals with separate spray guns. In all cases, care should be taken to completely spray any and all areas of the workpiece where the improved diffusion coating is desired.

Figure 2:
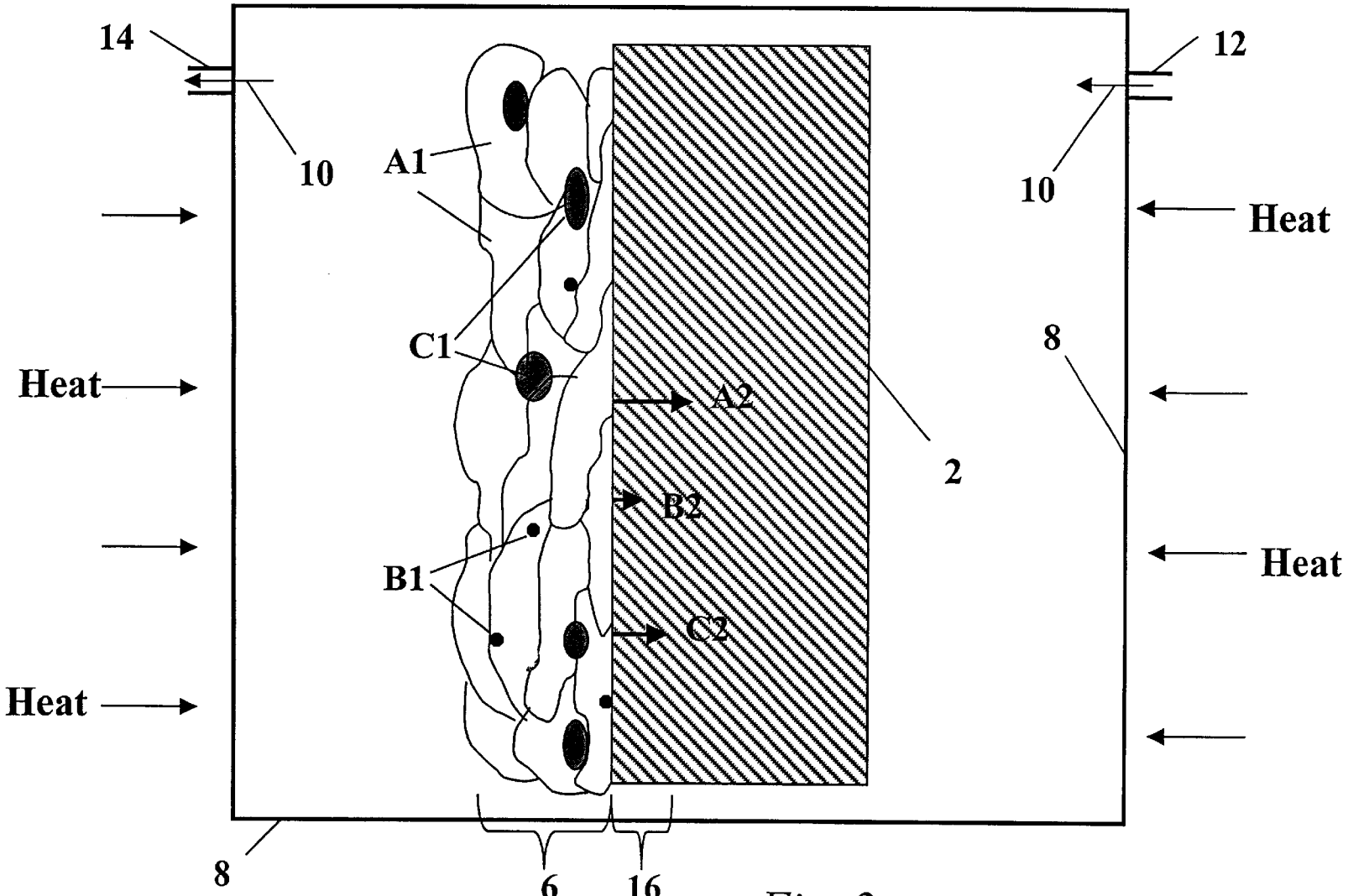
FIG. 2 is a schematic, cross-sectional representation of the diffusion process as achieved by the first embodiment of the present invention.

After molten feed material A1, B1, C1 is thermally sprayed onto the surface of workpiece 2 as described above, heat treating means is used to diffuse coating layer 6 into workpiece 2. Referring to FIG. 2, workpiece 2 is placed in retort 8 and heat is applied to retort 8 for a set time. Inert or reducing gas 10 may be provided to retort 8 through inlet 12 and removed through outlet 14. Advantageously, retort 8 is heated to between 800° C. and 1100° C., workpiece 2 is placed in retort 8 for 2 to 15 hours, and argon is used as inert or reducing gas 10. However, one skilled in the art will understand that any reducing or inert atmosphere should suffice; that inert or reducing gas 10 may be stagnant (such that inlet 12 and outlet 14 are unnecessary) or flowing (as shown); and that the time and temperature need only be sufficient to effect the diffusion of coating layer 6 into workpiece 2.

Because chromium diffuses more slowly than aluminum at the optimum heat treating temperatures, molten feed material A1, B1, C1, and consequently, both the feed material for the spray gun, not shown, and coating layer 6, will all need to contain more chromium than what is desired within the final diffusion coating of the workpiece 2. In contrast, boron diffuses at a faster rate than aluminum, such that a smaller amount of boron is need in the molten feed material A1, B1, C1 than what is desired within the final diffusion coating of the workpiece 2.

Consequently, as indicated by diffusion lines A2, B2, and C2 in FIG. 2, coating layer 6 will diffuse into workpiece 2 so as to form diffusion layer 16 with improved fracture toughness. Further, the length of A2 corresponds with the fact that a greater amount of aluminum will diffuse into the workpiece than B2, which represents the overall amount of diffused boron, and C2, which represents the overall amount of diffused chromium (again keeping in mind that the present invention does not necessarily require both chromium and boron to be provided in combination). Likewise, the length of C2 relative to that of B2 depicts the fact that more chromium will diffuse into the workpiece than boron. Notably, however, both FIG. 1 and FIG. 2 are simply relative depictions and it is understood that neither is drawn to scale.

Further, it should be appreciated that formation of diffusion layer 16 is effected in a single step. Thus, workpiece 2 will only require one heat treatment in retort 8, thereby minimizing costs and more generally reducing the complexities.

The second embodiment of the invention, the aluminum and chromium and/or boron are first applied to an inert ceramic media using any known thermal spray means and subsequently the ceramic media is placed in contact with the workpiece and the two are heated in order to effect the desired, simultaneous diffusion. Most advantageously, the ceramic media is alumina fabrics and cloth, although those skilled in the art will appreciate that any inert ceramic will suffice (guidance for the selection of the appropriate media can be found in Davis, supra). Further, the thermal spray means comprises any available commercial thermal spray process, such as wire arc spraying or plasma spraying. In such a process, a feed material made of the desired coating material is fed into a gun, which is heated by electricity and/or combustion. Preferably, the feed material is a powder or wire, although any solid suitable for use with the gun is contemplated. After being fed into the gun, the feed material melts.

Figure 3:
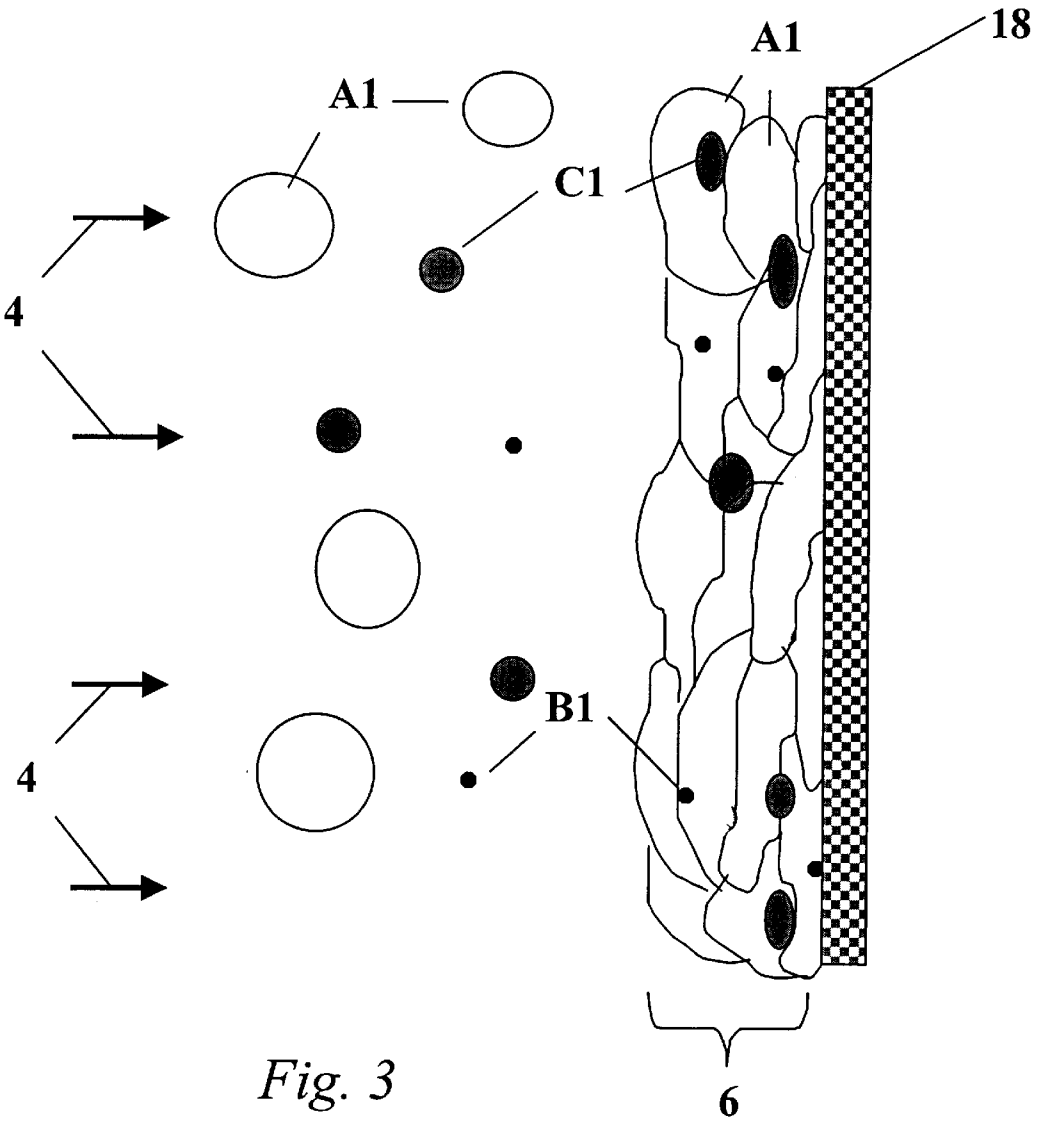
FIG. 3 is a schematic, cross-sectional representation of the thermal spray process as applied to the second embodiment of the present invention.

Referring to FIG. 3, the molten feed material, generally shown as A1, B1, and C1, is then propelled from the gun (not shown) toward inert ceramic media 18 by gas means 4. The gas 4 may be argon, nitrogen, combustion gases (either derived from the heating of the gun or separately provided), compressed air, or any gas suitable for use with the particular thermal spray process. Small diameter particles (10–50 microns) of the molten feed material A1, B1, C1 are accelerated toward ceramic media 18. A1 represents molten aluminum. B1 represents molten boron and C1 represents molten chromium, although it is understood that the invention encompasses the use of either boron or chromium singly (such that only B1 or only C1 is provided; not shown) or in combination (as shown).

The small diameter particles of molten feed material A1, B1, C1 then contact the ceramic media 18, where they form coating layer 6. Coating layer 6 forms after molten feed material A1, B1, C1 cools and bonds to the surface of ceramic media 18. Coating layer 6 typically consists of particles of varying sizes, shapes, and degrees of melting.

In order to achieve the simultaneous spraying (and subsequent diffusion) of the aluminum, chromium, and boron, these metals are provided in a feed material as discussed above. Notably, the feed material must have the constituent metals distributed uniformly. This uniformity may be achieved by mixing the powdered forms of these metals, by melting and mixing the metals into an alloyed solid, or by other uniform mixing means known to those skilled in the art. Alternatively, uniformity may be achieved by simultaneously thermally spraying the metals with separate spray guns. In all cases, care should be taken to completely spray any and all areas of the workpiece where the improved diffusion coating is desired.

After molten feed material A1, B1, C1 is thermally sprayed onto the surface of ceramic media 18, as described above, the media 18 is subsequently placed into contact with workpiece 2. However, as will be appreciated by FIG. 4, the coating layer 6 will form the actual contact point between workpiece 2 and media 18.

Figure 4:
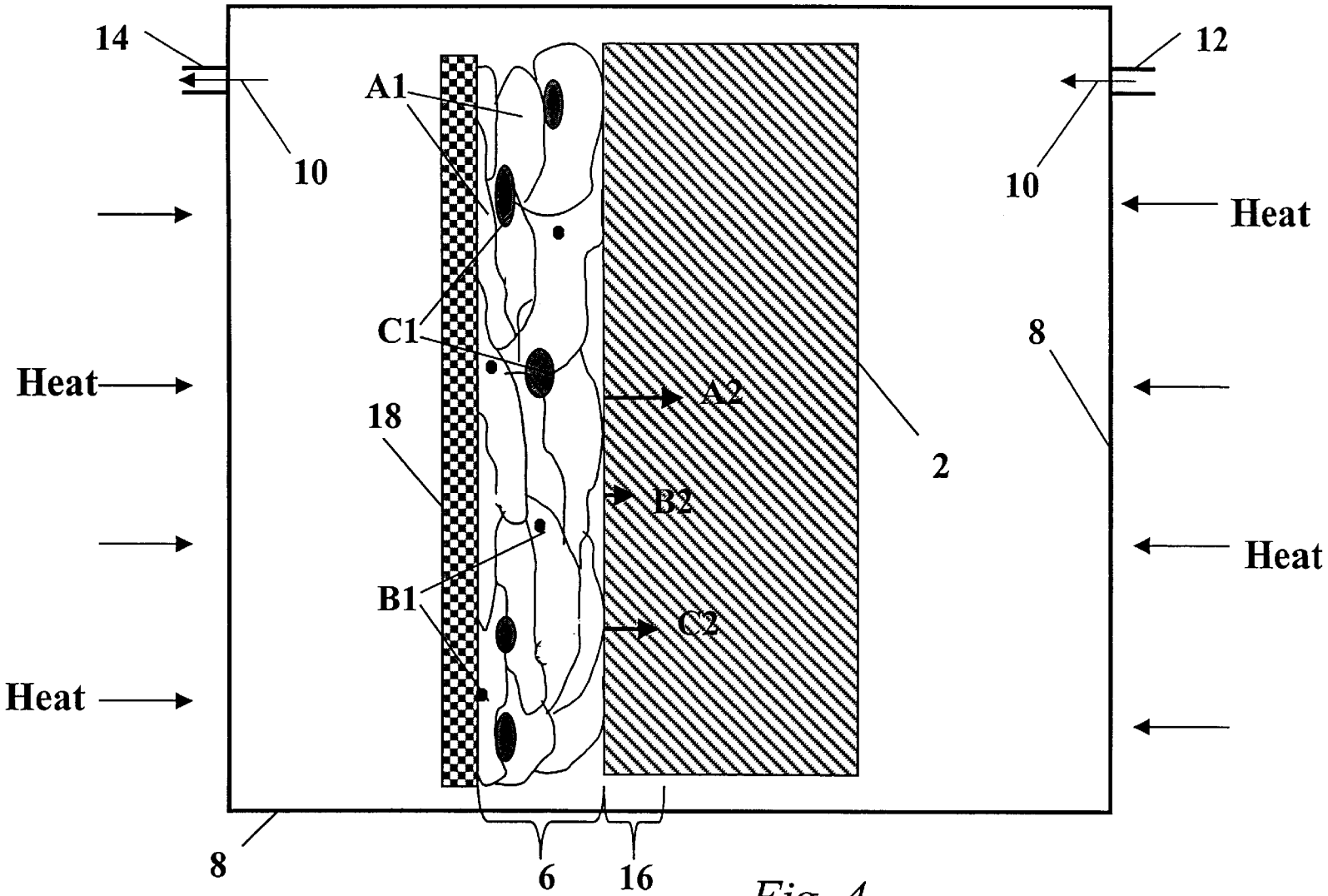
FIG. 4 is a schematic, cross-sectional representation of the diffusion process as achieved by the second embodiment of the present invention.

Next, heat treating means is used to diffuse coating layer 6 from the ceramic media 18 into workpiece 2. Referring to FIG. 4, workpiece 2 and media 18 are placed in retort 8 and heat is applied to retort 8 for a set time. Inert or reducing gas 10 may be provided to retort 8 through inlet 12 and removed through outlet 14. Advantageously, retort 8 is heated to between 800° C. and 1100° C., workpiece 2 and media 18 are placed in retort 8 for 2 to 15 hours, and argon is used as inert or reducing gas 10. However, one skilled in the art will understand that any reducing or inert atmosphere should suffice; that inert or reducing gas 10 may be stagnant (such that inlet 12 and outlet 14 are unnecessary) or flowing (as shown); and that the time and temperature need only be sufficient to effect the diffusion of coating layer 6 into workpiece 2.

Because chromium diffuses more slowly than aluminum at the optimum heat treating temperatures, molten feed material A1, B1, C1, and consequently, both the feed material for the spray gun, not shown, and coating layer 6, will all need to contain more chromium than what is desired within the final diffusion coating of the workpiece 2. In contrast, boron diffuses at a faster rate than aluminum, such that a smaller amount of boron is need in the molten feed material A1, B1, C1 than what is desired within the final diffusion coating of the workpiece 2.

Consequently, as indicated by diffusion lines A2, B2, and C2 in FIG. 2, coating layer 6 will diffuse into workpiece 2 so as to form diffusion layer 16 with improved fracture toughness. Further, the length of A2 corresponds with the fact that a greater amount of aluminum will diffuse the workpiece than B2, which represents the overall amount of diffused boron, and C2, which represents the overall amount of diffused chromium (again keeping in mind that the present invention does not necessarily require both chromium and boron to be provided in combination). Likewise, the length of C2 relative to that of B2 depicts the fact that more chromium will diffuse into the workpiece than boron. Notably, however, both FIG. 3 and FIG. 4 are simply relative depictions and it is understood that neither is drawn to scale.

Further, it should be appreciated that formation of diffusion layer 16 is effected in a single step. Thus, workpiece 2 will only require one heat treatment in retort 8, thereby minimizing costs and more generally reducing the complexities. Moreover, use of a ceramic media 18 simplifies the invention by allowing an individual to spray the ceramic in one step; shape the ceramic to the workpiece concurrently or subsequently; and/or ship the ceramic to effect the desired diffusion on the workpiece at a later time and/or at a separate location.

In either of the embodiments described above, a small amount of silicon may be added to the feed material. This addition of silicon lowers the melting temperature of the metals to be diffused, thereby making the feed materials more sticky on the substrate surfaces. However, the silicon itself does not impact or influence the resulting coating.

Further, the optimum range for each of the constituent components of the feed material may be measured as a function of atomic percent. Atomic percent refers to the number of moles of a given element divided by the total number of moles of all elements in the feed material. For example, in the compound $Fe_3Al$, the atomic percentage of aluminum would be 25% (1 mole of Al/4 moles total). Atomic percent is equivalent to molar percent.

The preferred atomic percentages of the feed material for either embodiment are as follows: of 89% to 95% aluminum, 5 to 10% chromium, and 0.1% to 1% boron. In the event that silicon is also used, the preferred percentages are: 88% to 94.9% aluminum, 5% to 10% chromium, 0.1% to 1% boron, and 0.1% to 1% silicon.

Although the disclosed invention is expected to have particular application to the boiler industry, the preferred embodiments of this invention are equally applicable for a wide range of aluminizing needs, such that tubes, bolts, panels, bearings, fasteners, and other parts may be treated. Further, through the use of the alumina-fabrics embodiment, it is contemplated that a variety of curved, spherical, or otherwise uneven surfaces may be quickly and effectively treated by this method, without the need for precise positioning of the spray gun(s) and/or precise, even spray coverage of the workpiece (presumably, such even coverage will be performed in a more controlled environment on the ceramic media).

What is claimed is:

1. A method for increasing the fracture toughness of an aluminum-based thermal spray diffusion coating into a steel surface of a workpiece, the method comprising:

preparing a feed material consisting essentially of 89% to 94.9% aluminum by atomic percent (at. %), 5 to 10% chromium by % at., and 0.1% to 1% boron by % at.;

applying the feed material onto a workpiece by a thermal spray means;

heat treating the steel surface under an inert or reducing atmosphere for a sufficient time to cause the feed material to diffuse into the workpiece; and removing any excess, undiffused feed material from the workpiece.

2. A method according to claim 1, wherein the thermal spray means is selected from the group consisting of plasma spray and arc spray.

3. A method according to claim 1, further comprising the step of alloying the aluminum and at least one of: chromium and boron into a uniform, solid material prior to the step of applying the feed material onto a workpiece.

4. A method according to claim 1, wherein the heat treating comprises heating the workpiece between 800° C.–1,100° C. under an inert or reducing atmosphere for 2 to 15 hours.

5. A method for increasing the fracture toughness of an aluminum-based thermal spray diffusion coating into a steel surface of a workpiece, the method comprising:

preparing a feed material consisting essentially of 88% to 94.8% aluminum by atomic percent (at. %), 5% to 10% chromium by % at., 0.1% to 1% boron by % at., and 0.1% to 1% silicon by % at.;

applying the feed material onto a workpiece by a thermal spray means;

heat treating the steel surface under an inert or reducing atmosphere for a sufficient time to cause the feed material to diffuse into the workpiece; and removing any excess, undiffused feed material from the workpiece.

6. A method according to claim 5, wherein the thermal spray means is selected from the group consisting of plasma spray and arc spray.

7. A method according to claim 5, wherein the heat treating comprises heating the workpiece between 800° C.–1,100° C. under an inert or reducing atmosphere for 2 to 15 hours.

8. A method according to claim 5, comprising the step of alloying the aluminum and at least one of: chromium, boron and silicon into a uniform, solid material prior to the step of applying the feed material onto a workpiece.

9. A method for increasing the fracture toughness of an aluminum-based diffusion coating by simultaneously diffusing aluminum, and at least one of: chromium and boron, into a steel surface of a workpiece, the method comprising:

preparing a feed material having aluminum and at least one of: chromium and boron;

applying the feed material onto a ceramic media by a thermal spray means;

positioning the ceramic media in contact with the workpiece;

heat treating the media and the steel surface for a sufficient time to cause the aluminum and at least one of: chromium and boron to diffuse into the workpiece; and removing any excess, undiffused feed material and the ceramic media from the workpiece.

10. A method according to claim 9, wherein the feed material further comprises silicon.

11. A method according to claim 10, wherein the feed material consists essentially of 88% to 94.8% aluminum by atomic percent (at. %), 5% to 10% chromium by % at., 0.1% to 1% boron by % at., and 0.1% to 1% silicon by % at.

12. A method according to claim 9, wherein the feed material consists essentially of 89% to 94.9% aluminum by atomic percent (at. %), 5 to 10% chromium by % at., and 0.1% to 1% boron by % at.

13. A method according to claim 9, wherein the heat treating comprises heating the media and the workpiece between 800° C.–1,100° C. under an inert or reducing atmosphere for 2 to 15 hours.

14. A method according to claim 9, wherein the preparing the feed material further comprises alloying the aluminum and at least one of: chromium and boron into a uniform, solid material.

* * * * *